US006948201B2

(12) United States Patent
Yoshimori

(10) Patent No.: US 6,948,201 B2
(45) Date of Patent: Sep. 27, 2005

(54) CARE BED USED COMMONLY FOR BATHING AND TOILETING

(76) Inventor: Junichi Yoshimori, 1-871, Jinguudoori, Yawatahama-shi, Ehime 796-0088 (JP)

( * ) Notice: Subject to any disclaimer, the term of this patent is extended or adjusted under 35 U.S.C. 154(b) by 0 days.

(21) Appl. No.: 10/485,689

(22) PCT Filed: Aug. 8, 2002

(86) PCT No.: PCT/JP02/08103

§ 371 (c)(1),
(2), (4) Date: Feb. 3, 2004

(87) PCT Pub. No.: WO03/017907

PCT Pub. Date: Mar. 6, 2003

(65) Prior Publication Data

US 2004/0168252 A1 Sep. 2, 2004

(30) Foreign Application Priority Data

Aug. 24, 2001 (JP) ..... 2001-304190

(51) Int. Cl.[7] ..... A47K 3/12
(52) U.S. Cl. ..... 5/604; 5/600; 5/83.1 R; 5/900
(58) Field of Search ..... 5/604, 614, 83.1, 5/600, 900; 4/560.1–566

(56) References Cited

U.S. PATENT DOCUMENTS 5,235,710 A * 8/1993 Nagashima ..... 4/563.1

FOREIGN PATENT DOCUMENTS

| | | | |
|---|---|---|---|
| JP | 60-19251 | B2 | 5/1985 |
| JP | 4-122212 | A | 4/1992 |
| JP | 5-277150 | A | 10/1993 |
| JP | 2590767 | B2 | 3/1997 |
| JP | 11-318999 | A | 1/1999 |
| JP | 11-56924 | A | 3/1999 |
| JP | 11-197194 | A | 7/1999 |
| JP | 2000-262565 | A | 9/2000 |
| JP | 2001-79045 | A | 3/2001 |

* cited by examiner

*Primary Examiner*—Heather Shackelford
*Assistant Examiner*—Fredrick Conley
(74) *Attorney, Agent, or Firm*—Varndell & Varndell, PLLC

(57) ABSTRACT

A care bed used commonly for bathing and toileting allowing a labor burden on a carer in bathing and toileting of a bedridden sufferer to be minimized, which could not be performed by a conventional care bed, comprising a bed having a plurality of vertical grooves disposed on a bath tub; arms fittedly inserted to the plurality of vertical grooves, and a lift capable of horizontally raising and longitudinally moving the arms after the arms are fittedly inserted into the plurality of vertical grooves.

8 Claims, 10 Drawing Sheets

CARE BED USED COMMONLY FOR BATHING AND TOILETING

TECHNICAL FIELD

The present invention relates to a care bed for a sufferer such as a bedridden aged person requiring a care. In particular, the present invention relates to a care bed capable of remarkably reducing the labor burden on carers to operate a care for the sufferer.

BACKGROUND ART

Conventionally, with regards to a care bed for a sufferer such as a bedridden aged person requiring a care, such a care bed has been mainly used that only allows the sufferer to easily rise from the bed by changing the angle of the backrest.

With a conventional care bed, on an occasion where a bedridden sufferer uses a bath or defecates in a toilet, a carer to perform various care actions requiring much labor burden such as to move the sufferer from the care bed or to move back the sufferer to the care bed.

The present invention was made in view of the above, and aims at providing a care bed used commonly for bathing and provided to reduce the labor burden to a carer as much as possible when the carer helps a bedridden sufferer use a bath or a toilet.

DISCLOSURE OF THE INVENTION

A care bed used commonly for bathing and toileting according to the present invention comprises a bed having a plurality of vertical grooves disposed on a bath tub; and a lift having arms to be inserted into the plurality of vertical grooves, for lifting horizontally and movable back and forth after the arms are inserted to the plurality of vertical grooves, thus allowing even a carer of advanced age to help a sufferer to have a bath and to move to a toilet easily.

BEST MODE FOR CARRYING OUT THE INVENTION

Embodiment of a care bed used commonly for bathing and toileting according to the present invention will be described in detail.

Figure 1:
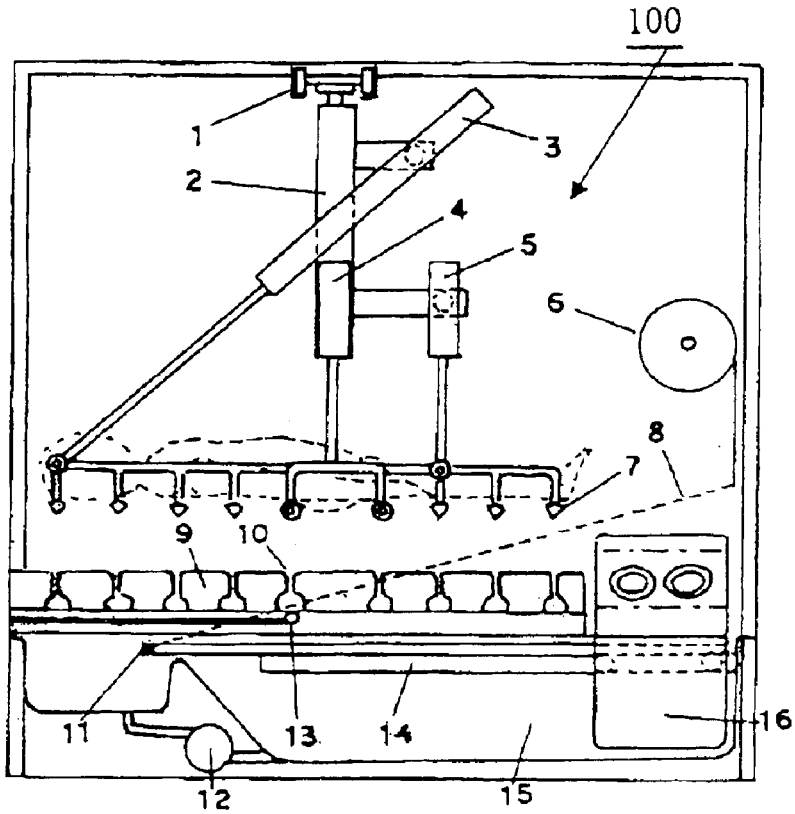
FIG. 1 is a front view of a care bed used commonly for bathing and toileting that is attached with a lift.

FIG. 1 is a front view of the care bed used commonly for bathing and toileting according to the present invention, and particularly a lift 100 is attached to the bed.

This lift 100 is attached so as to be movable in forward and backward directions (in a perpendicular direction to the drawing) by a gear motor 1 for forward and backward movements having a roller movable in rails.

The lift 100 comprising a main hydraulic lift 2 having a hydraulic pump; a hydraulic lift 3 having an arm adjustment hydraulic pump for an upper body; a fixed auxiliary hydraulic lift 4; and a bobbing (or pivoting) type auxiliary hydraulic lift 5.

Figure 5:
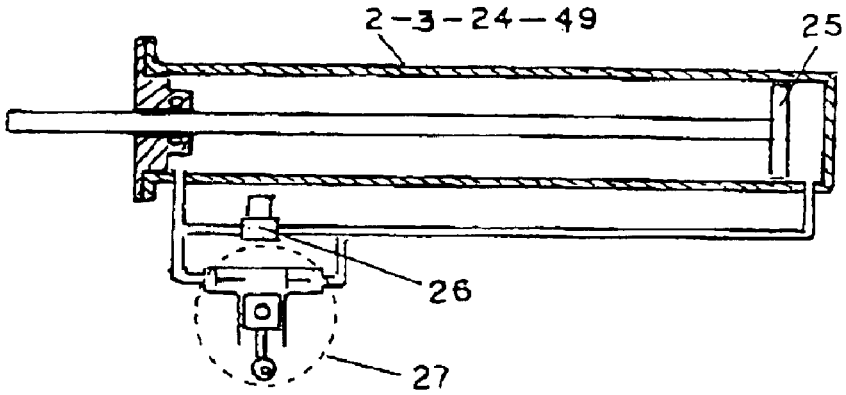
FIG. 5 is a cross-sectional view of a hydraulic lift having a hydraulic pump.

Among them, the main hydraulic lift 2 having a hydraulic pump and the hydraulic lift 3 having an arm adjustment hydraulic pump for an upper body are hydraulic lifts having a hydraulic pump to which a hydraulic pump 27 and a solenoid valve 26 are attached as shown in FIG. 5.

Figure 6:
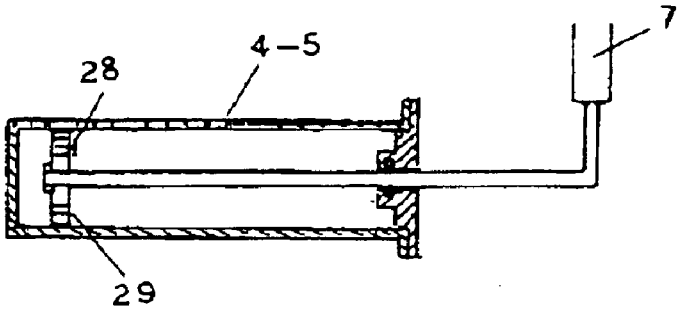
FIG. 6 is a cross-sectional view of an auxiliary hydraulic lift.

The fixed auxiliary hydraulic lift 4 and the bobbing type auxiliary hydraulic lift 5 are auxiliary hydraulic lifts to which a check valve 28 and a hole 29 are attached as shown in FIG. 6.

Arms 7 shown in FIG. 1 are provided so as to be inserted into vertical grooves 10 of a bed 9 having vertical grooves.

This bed 9 having vertical grooves is provided by preparing individual bed elements and attaching each bed element to a base board by bolts from the lower side, thereby allowing the entirety of the bed to be foldable. As a sheet for covering the bed 9, hat-like sheet pieces are put on each of the bed elements, respectively.

Figure 2:
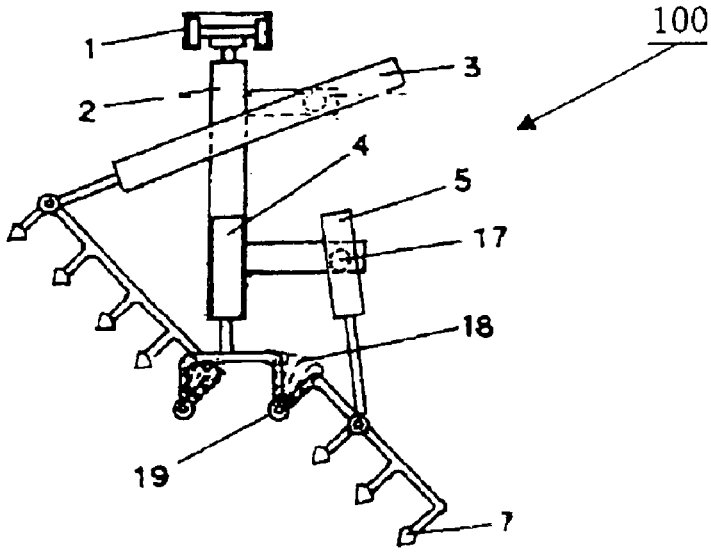
FIG. 2 is a front view of the lift.

FIG. 2 is the front view illustrating the movements of main hydraulic lift 2 having a hydraulic pump, hydraulic lift 3 having an arm adjustment hydraulic pump for upper body, fixed auxiliary hydraulic lift 4, bobbing type auxiliary hydraulic lift 5, and arms 7 of the lift 100.

Figure 3:
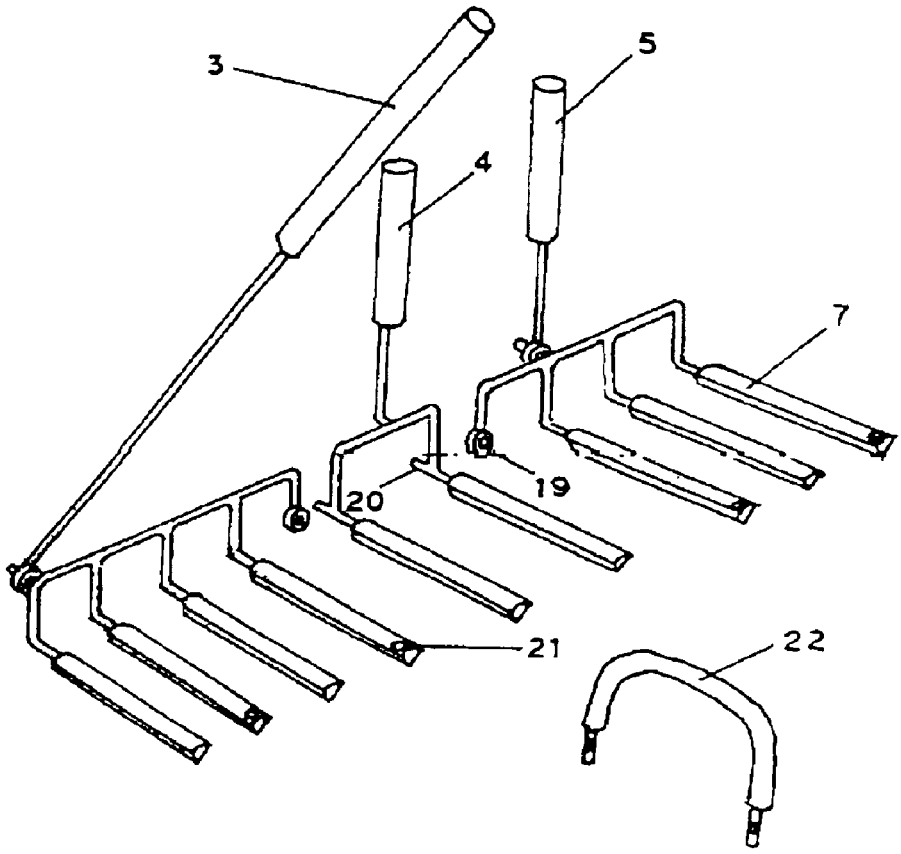
FIG. 3 is a perspective view of the lift arm.

FIG. 3 is a perspective view illustrating how the hydraulic lift 3 having arm adjustment hydraulic pump for upper body, the fixed auxiliary hydraulic lift 4, and the bobbing type auxiliary hydraulic lift 5 are attached to the arms 7.

A part of the arms 7 that contacts with the back of a sufferer is covered with soft rubber that is well drained.

Figure 4:
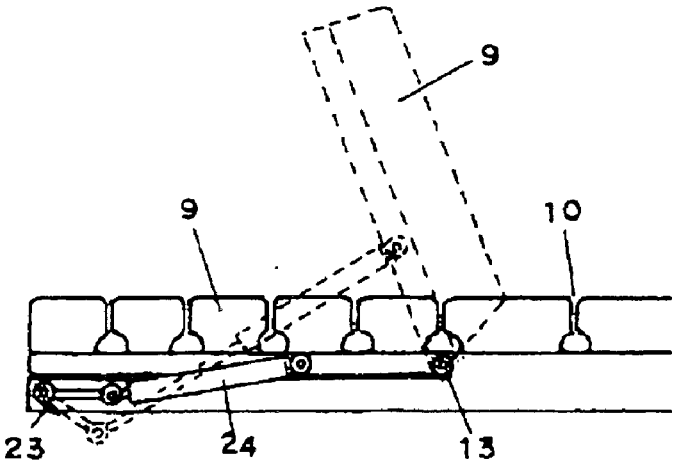
FIG. 4 is a side view of a bed backrest adjustment hydraulic machine.

FIG. 4 is a side view of how the bed 9 having vertical grooves 10 is attached. The upper body part can be set at any angle by a shaft 13 and a backrest adjustment hydraulic machine 24.

FIG. 5 is a cross-sectional view of the hydraulic lift having a hydraulic pump. The hydraulic lift has a solenoid valve 26 and a hydraulic pump 27. To lift the bed, the hydraulic pump 27 is operated. When the bed is lowered, the solenoid valve 26 is opened so that the bed is lowered by the load.

Figure 8:
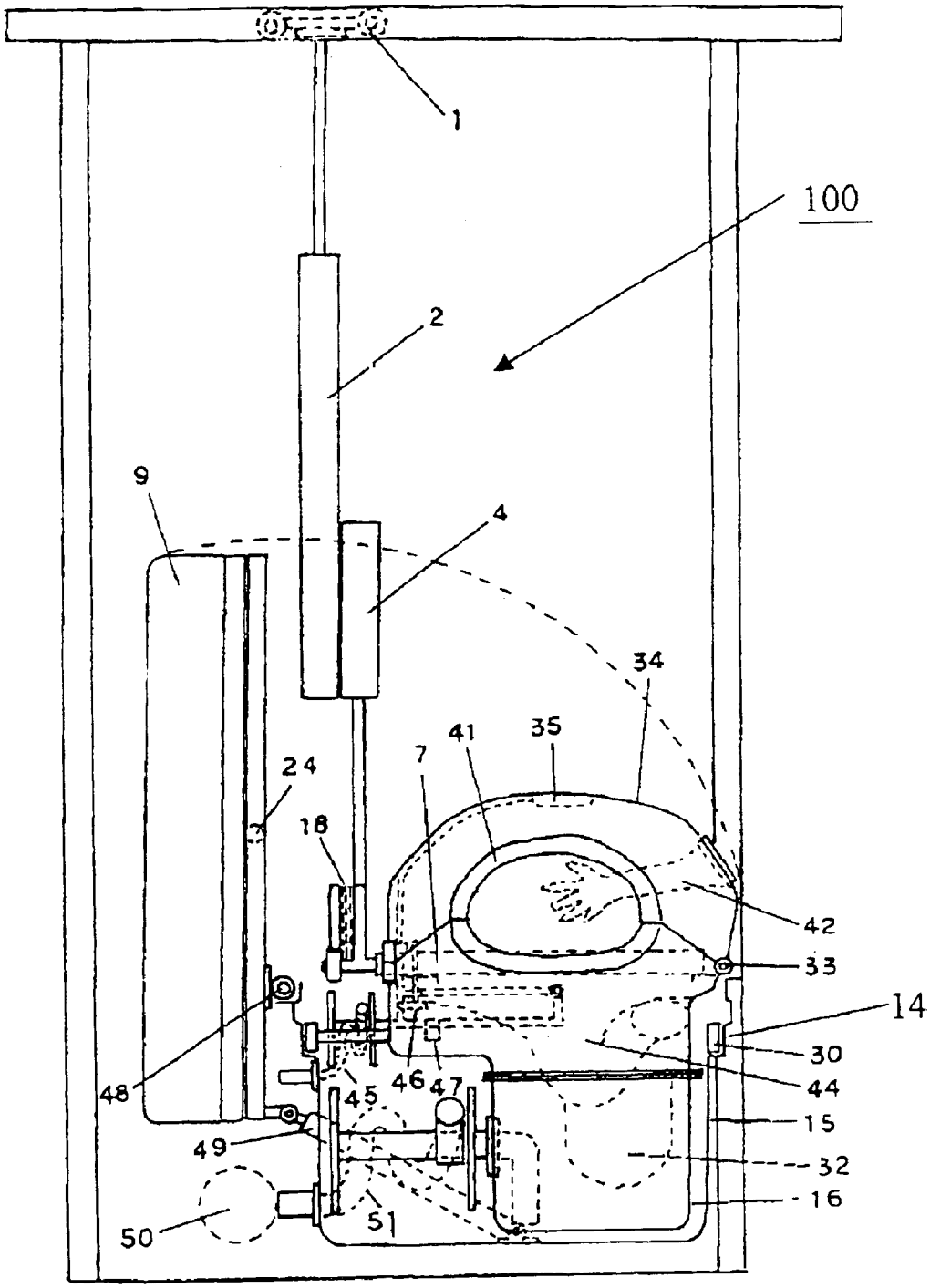
FIG. 8 is a side view of the toilet that allows a user to use the toilet while lying down on the bed and a lift.

It is noted that this hydraulic lift having a hydraulic pump is used in the main hydraulic lift 2 having a hydraulic pump, the hydraulic lift 3 having an arm adjustment hydraulic pump for upper body, and a hydraulic machine 49 having a hydraulic pump for opening and closing a bath tub (FIG. 8). In the backrest adjustment hydraulic machine 24, a check valve of the hydraulic pump is attached in a reverse manner.

FIG. 6 is a cross-sectional view of the auxiliary hydraulic lift that has a check valve 28 and a hole 29 for moving oil in upward and downward directions. The check valve 28 is a valve for releasing to accelerate the upward movement of the arm 7. The hole 29 is a hole for maintaining the descending speed of the arm 7.

The use of this auxiliary hydraulic lift prevents a user, when the body of the user is caught by arms 7, from being applied with a load other than a load by the body weight of the user. It is noted that this auxiliary hydraulic lift is used in the fixed auxiliary hydraulic lift 4 and the bobbing type auxiliary hydraulic lift 5.

Figure 7:
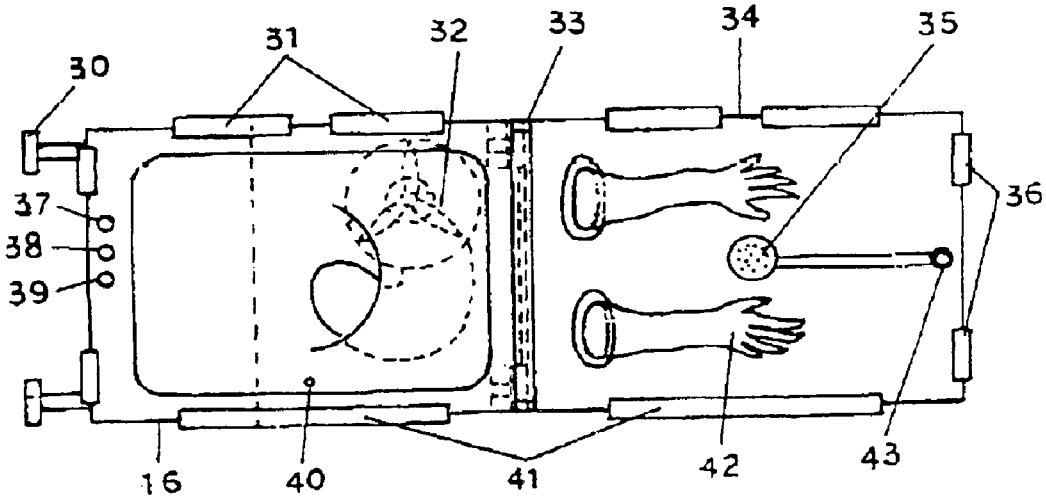
FIG. 7 is a plan view of a toilet that allows a user to use the toilet while lying down on the bed.

FIG. 7 is a plan view of the toilet 16 that allows a user to use the toilet while lying down on the bed.

FIG. 8 is a side view of the toilet 16 that allows a user to use the toilet while lying down on the bed and the lift 100.

In using the toilet 16, the toilet 16 is pushed to the center moving in the bath tub 15 by the roller 30 in the roller groove 14.

Whenever the toilet is used, wastewater from the toilet is discharged by a toilet wastewater hose 51 via a toilet drain pump 50. Water is fed via a water feed hose 45 and is separately fed for shower and toilet wastewater by a shower-and-washing feed valve 46 and a toilet-bowl-cleaning feed valve 47, each of the hoses is wound by a rotation drum.

Rubber gloves 42 for disposing waste and a waste cutter 32 for cutting the waste are attached inside.

Figure 9:
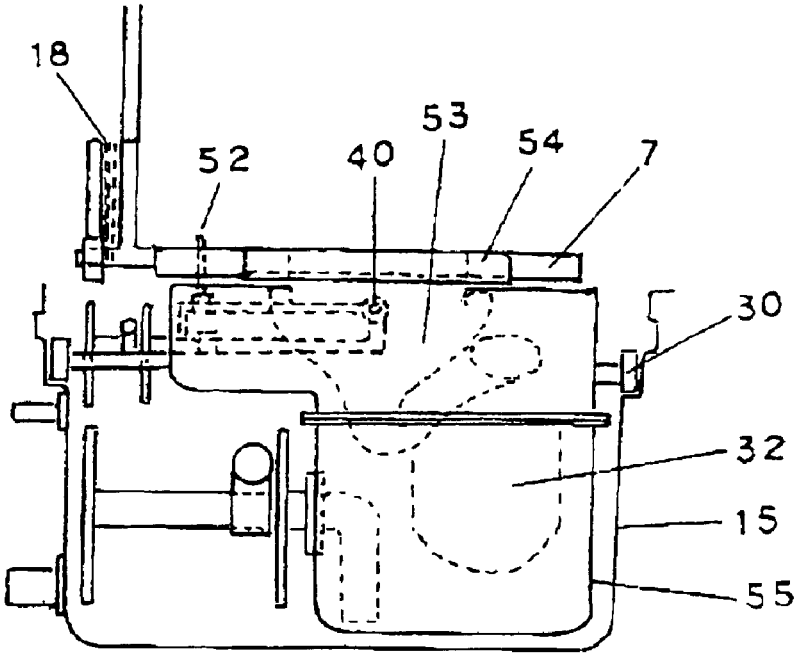
FIG. 9 is a side view of a toilet on which a user sits and a lift.

FIG. 9 is a side view of the toilet 55 on which a user sits and the lift.

Figure 10:
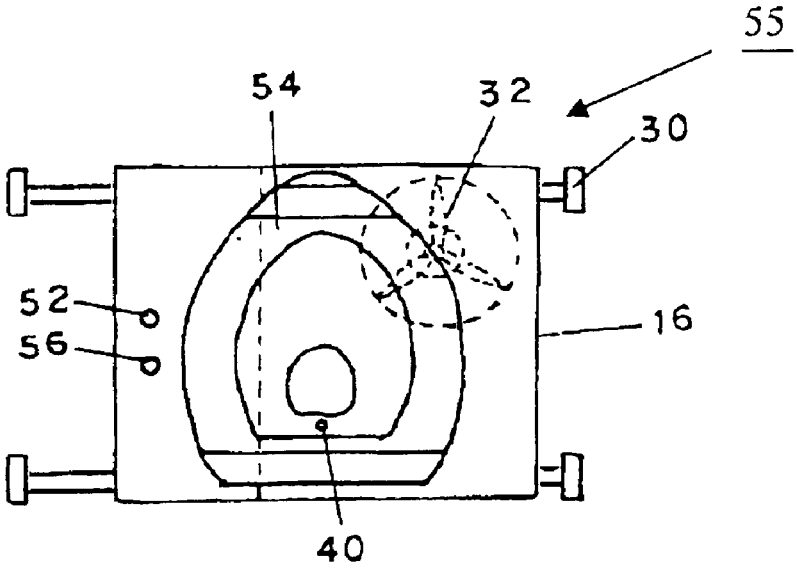
FIG. 10 is a plan view of a toilet on which a user sits.

FIG. 10 is a plan view of the toilet 55 on which a user sits.

Systems for bathing and moving the toilet in the state where a sufferer is placed in the care bed used commonly for bathing and toileting structured as described above according to the present invention will be described.

First, bathing system will be described in the state where the sufferer lies on the bed 9, the main hydraulic lift 2 having a hydraulic pump in FIG. 1 is positioned at the lower position while the arms 7 are inserted in the vertical grooves 10 of the bed 9.

Firstly, a pillow, a blanket or the like on the bed 9 are removed and the sufferer in naked is placed at the center of the bed.

Then, the gear motor 1 for forward and backward movements having a roller is moved in the forward direction so that the sufferer is positioned at the center of the arms 7. A drop prevention frame 22 in FIG. 3 is inserted to a drop prevention frame insertion hole 21 to prevent the sufferer from dropping from the bed.

Next, the hydraulic pump 27 of the main hydraulic lift 2 having a hydraulic pump is moved in the upward direction to lift the sufferer (shown by the broken line) horizontally as shown in FIG. 1.

Next, the gear motor 1 for forward and backward movements having a roller is operated to move the sufferer in the forward direction. Then, the hydraulic pump 27 of the hydraulic machine 49 having a hydraulic pump for opening and closing a bath tub (FIG. 5) is operated as shown in FIG. 8 to allow the bed 9 having vertical grooves to be rotated and opened, thereby opening the top face of the bath tub 15.

Thereafter, the gear motor 1 for forward and backward movements having a roller is operated again to move the sufferer to the center of the bath tub. Then, the solenoid valve 26 of the main hydraulic lift 2 (FIG. 5) is opened to lower the arms 7 by the body weight of the sufferer.

As a result, the arms 7 are curved along the inner circumference of the bath tub 15 so that the sufferer is soaked into the bath tub 15 in a comfortable posture.

When the body of the sufferer is washed, the hydraulic pump 27 of the main hydraulic lift 2 is operated to lift the sufferer horizontally as shown in FIG. 1. Then, a washing sheet 8 is pulled out from a washing sheet winding unit 6 and is fixed to a metal stopper 11, and the body of the sufferer is washed.

After washing the body of the sufferer, water used when showering the body of the sufferer is flowed via the washing sheet 8 and is drained from the upper part of the bath tub 15. Therefore, the water in the bath tub 15 is not contaminated.

After the body is washed, the sufferer is again moved down into the bath tub 15 for bathing. When the bathing is completed, the hydraulic pump 27 of the main hydraulic lift 2 is operated to again lift the sufferer horizontally, and the body of the sufferer is dried.

Thereafter, the gear motor 1 for forward and backward movements having a roller is operated to move the sufferer in the forward direction. Then, the solenoid valve 26 (FIG. 5) of the hydraulic machine 49 having a hydraulic pump for opening and closing a bath tub (FIG. 8) is opened to return the bed 9 having vertical grooves to the initial position. Then, the gear motor 1 for forward and backward movements having a roller is operated again to move the sufferer to the center of the bed 9. The solenoid valve 26 of the main hydraulic lift 2 is opened to lower the sufferer by the body weight to insert the arms 7 in the vertical grooves 10 of the bed 9, thereby returning the sufferer onto the bed.

Thereafter, the drop prevention frame 22 is removed and the gear motor 1 for forward and backward movements having a roller is operated to move the arms 7 to the rearmost part (i.e., left end of FIG. 8), thereby completing the bathing.

Next, using of the toilet will be described.

First, a pillow and a blanket are removed while sufferer is lying on the bed 9 and the cloth of the lower body of the sufferer is removed. Then, the sufferer wearing only a disposable diaper is moved to the center of the arms 7 by moving the gear motor 1 for forward and backward movements having a roller in the forward direction. Then, the drop prevention frame 22 in FIG. 3 is inserted to the drop prevention frame insertion hole 21 to prevent the sufferer from being dropped. Then, the hydraulic pump 27 of the main hydraulic lift 2 having a hydraulic pump is operated to lift the body of the sufferer horizontally as shown in FIG. 1.

Next, the gear motor 1 for forward and backward movements having a roller is operated to move the arms 7 in the forward direction (i.e., to the right end of FIG. 8). Then, the hydraulic pump 27 of the hydraulic machine 49 having a hydraulic pump for opening and closing a bath tub is operated as shown in FIG. 8 to open the bed 9 having vertical grooves, and the arms 7 is again moved to the center of the bath tub 15 by operating the gear motor 1 for forward and backward movements having a roller.

Thereafter, while a cover 34 of the toilet 16 disposed in the bath tub 15 is being opened (FIG. 7), the toilet 16 that allows a user to use the toilet while lying down on the bed is moved to the center of the bath tub 15, and the solenoid valve 26 of the main hydraulic lift 2 having a hydraulic pump is opened to lower the body of the sufferer by the load. At this moment, the sufferer lies on his or her back while sitting on the toilet 16 that allows the sufferer to use the toilet while lying down on the bed.

Next, the cover 34 is closed and both hands of a carer are inserted into the gloves 42 to remove the disposable diaper. Then, a shower 35 and a washing nozzle 40 (FIG. 7) are operated to wash the sufferer to wash off the waste. Then, the waste is cut by the cutter 32 (FIG. 7) into small pieces, thereby draining the cut pieces of waste by the toilet drain pump 50 (FIG. 8).

After the waste is washed out, the cover 34 is opened and the hydraulic pump 27 of the main hydraulic lift 2 having a hydraulic pump is operated to lift the sufferer horizontally. Then, the lower body of the sufferer is wiped and the sufferer is returned to the bed 9 by following the above steps in the reverse order, thereby completing the toileting operations.

For a sufferer who can defecate without using a disposable diaper, a toilet bowl 55 on which a user can sit as shown in FIG. 9 is used. This toilet bowl 55 is moved to the center of the bath tub 15, and the solenoid valve 26 of the main hydraulic lift 2 having a hydraulic pump is opened to lower the sufferer by the load. At this moment, the sufferer takes a posture of siting on the toilet bowl 55 on which a user can sit while lying on his or her back.

It is noted that although the solenoid valve 26 of the hydraulic lift 3 having an arm adjustment hydraulic pump for upper body is closed and the upper body is maintained horizontally, the arms 7 for the lower body connected to the bobbing type auxiliary hydraulic lift 5 are bent in the lower direction.

Next, the hydraulic pomp 27 of the hydraulic lift 3 having an arm adjustment hydraulic pump for upper body is operated to lift the backrest so that the backrest is moved as shown in FIG. 2, thereby allowing the sufferer to sit on the toilet for defecation. After the defecation, the sufferer is returned to the bed 9 by following the above steps in the reverse order, thereby completing the toileting operations.

To raise the bed backrest, the solenoid valve of the hydraulic lift 3 having an arm adjustment hydraulic pump for upper body is opened to operate the hydraulic pump 27 (FIG. 5) of the backrest adjustment hydraulic machine 24 (FIG. 4) in a state where the arms 7 around the upper body are freely movable, thereby adjusting the backrest to a desired angle.

To return the backrest to the initial position, the solenoid valve 26 of the backrest adjustment hydraulic machine 24 is opened so as to allow the body weight of the sufferer to return the sufferer to the initial position.

The steps as described above can be performed electrically by providing a limit switch at each point, thus minimizing the labor burden to the carer when moving the sufferer to bathing or toileting.

It is noted that 24-volt power sources are used for the power sources of the hydraulic pump 27 and the solenoid valve 26, etc. in consideration of the risk of leakage of electricity.

The reference numerals in the drawings that are not explained represent the following components. Reference numeral 12 represents a bath tub drain pump; 13 represents a backrest bending shaft; 17 represents a bearing; 18 represents a fan-shaped folding plate; 19 represents a bearing; 20 represents a shaft; 23 represents a stopper; 31 represents a waterproofing rubber for feet; 33 represents an open/close shaft; 36 represents a waterproofing rubber for arms; 37 represents a push button of feed valves for shower and a washing nozzle; 38 represents a push button of the feed valve for toilet washing water; 39 represents a shower water feed tube; 40 represents a washing nozzle; 41 represents a waterproofing rubber for body; 43 represents a shower water feed tube; 44 represents a toilet bowl; 52 represents a push button for a washing nozzle feed valve; 53 represents a toilet bowl; 54 represents a toilet seat; and 56 represents a push button for a toilet washing feed valve.

It is noted that there is a case where the main hydraulic lift 2 having a hydraulic pump of the lift 100 cannot be accommodated in a house of a person requiring home care due to the structure of the house, such as a house with low ceiling.

The operating range of the hydraulic lift is limited to the length of the shaft of the hydraulic lift 2. To expand the operating range of the lift 100, a hydraulic lift 2 having a long shaft must be used. However, such a hydraulic lift 2 with a long shaft is difficult to install in a room with low ceiling.

Figure 11:
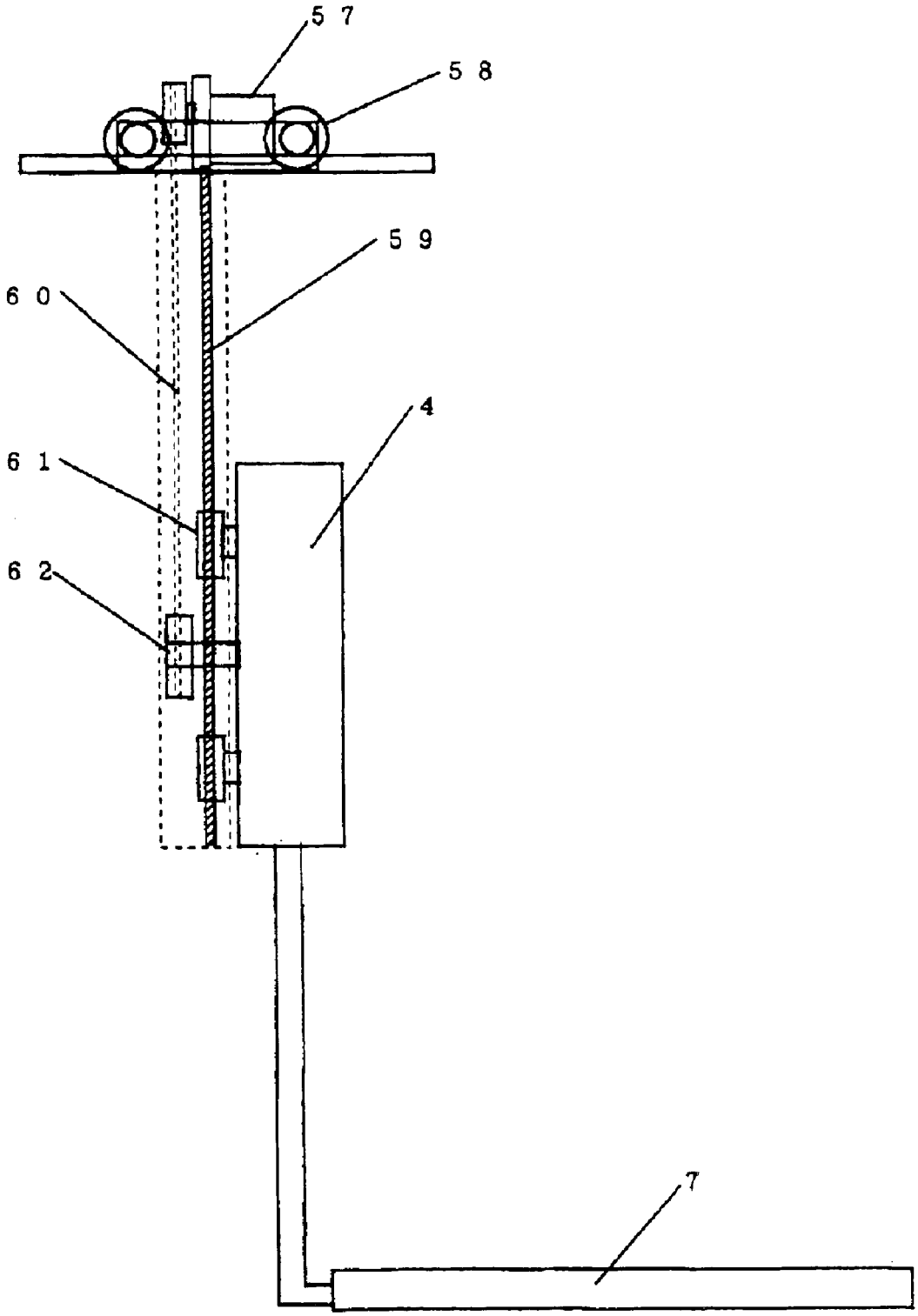
FIG. 11 is a front view of a lift in which the arm is lifted by winding up the wire by the gear motor.
Figure 12:
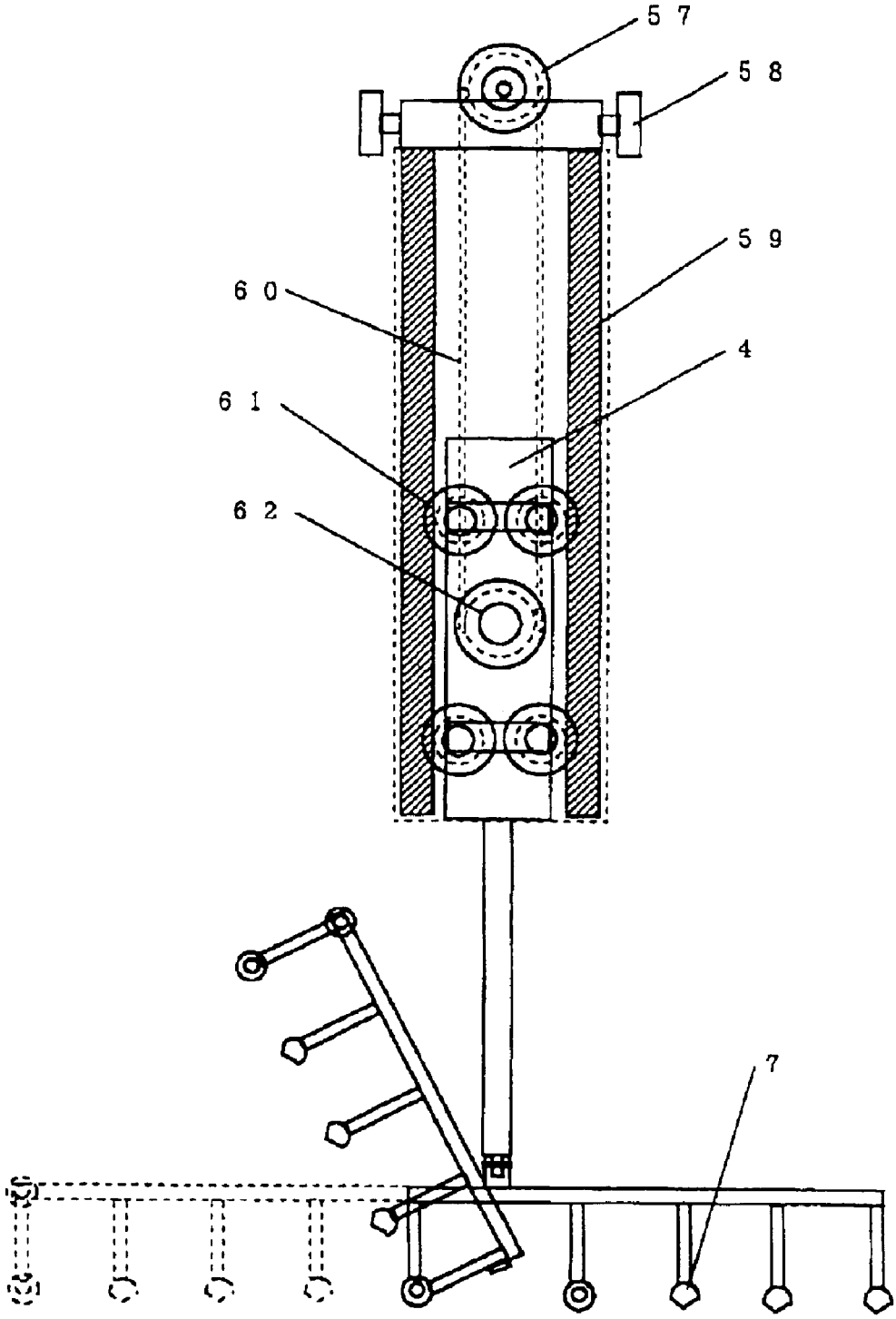
FIG. 12 is a side cross sectional view of the lift in which the arm is lifted by winding up the wire by the gear motor.

Thus, as shown in other embodiments illustrated in FIG. 11 and FIG. 12 in which same elements are represented by the same reference numerals in FIG. 1, a so-called wire suspension type is employed in place of the hydraulic lift 2, in which arms are suspended by a wire 60 which is moved up and down by a gear motor 57.

In FIG. 11 and FIG. 12, reference numeral 58 represents a roller; 59 represents rails; 60 represents wires; 61 represents a roller; and 62 represents a pulley.

Figure 13:
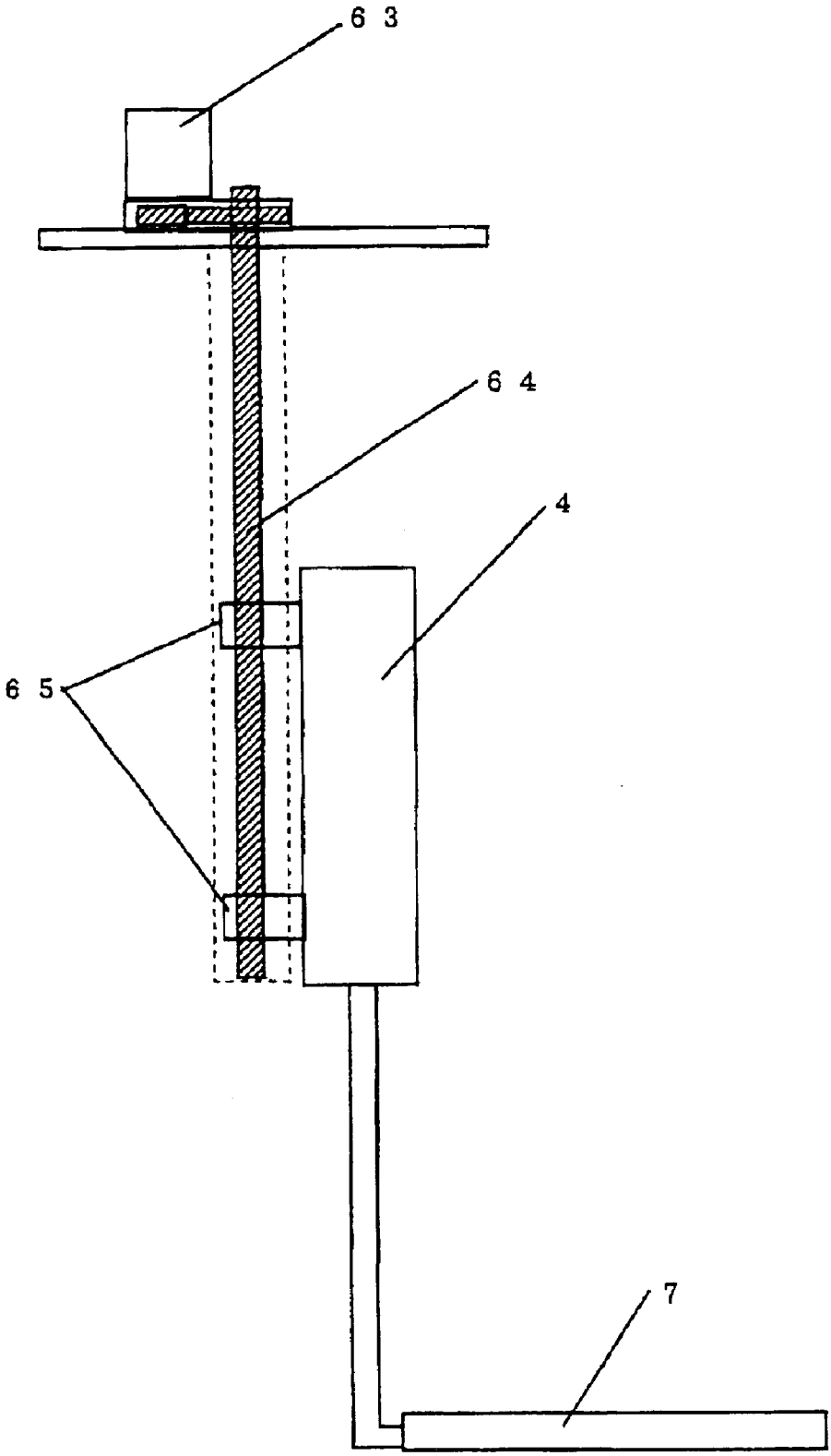
FIG. 13 is a side cross sectional view of a lift in which the arm is lifted by tightening up the screw by the gear motor.

Also, in place of the hydraulic lift 2 in FIG. 1, a so-called worm screw type lift is used in which a screw 64 is used for winding up by a gear motor 63 as shown in another embodiment in FIG. 13 in which the same reference numerals in FIG. 1 are used in the same elements. This allows only the fixed auxiliary hydraulic lift 4 to go up and down along the screw 64 (FIG. 13) or the rails 59 (FIG. 12), thereby allowing the bed to be installed even in a room with a low ceiling.

In FIG. 13, reference numeral 65 represents a nut screwed with the screw 64.

Figure 14:
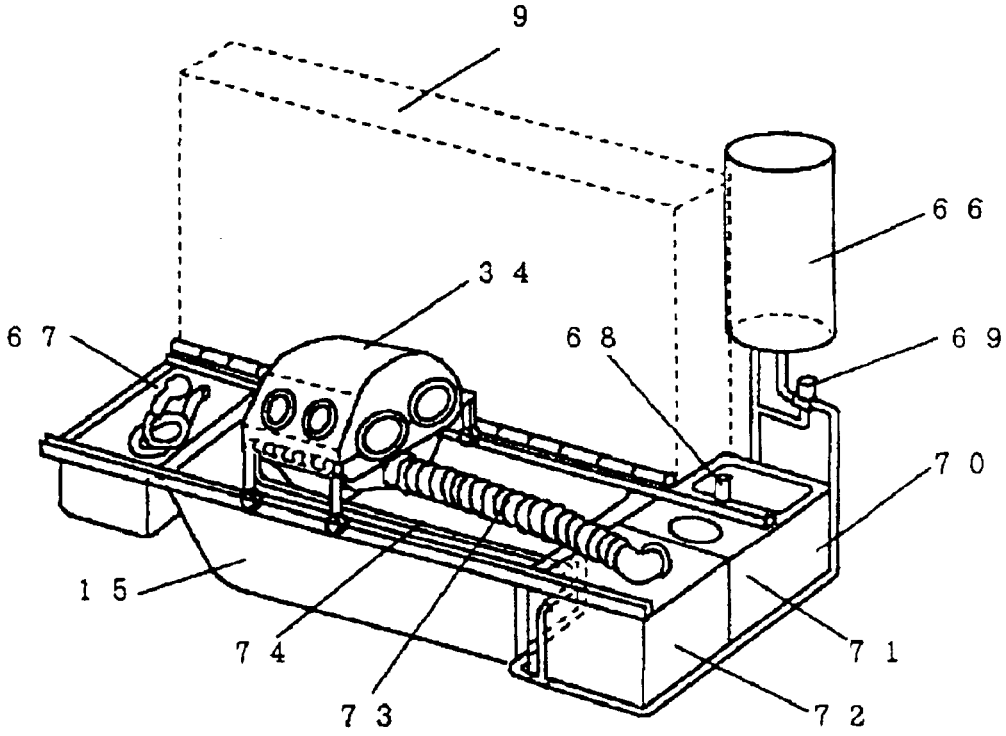
FIG. 14 is a perspective view in which a toilet is attached above a bath tub.
Figure 15:
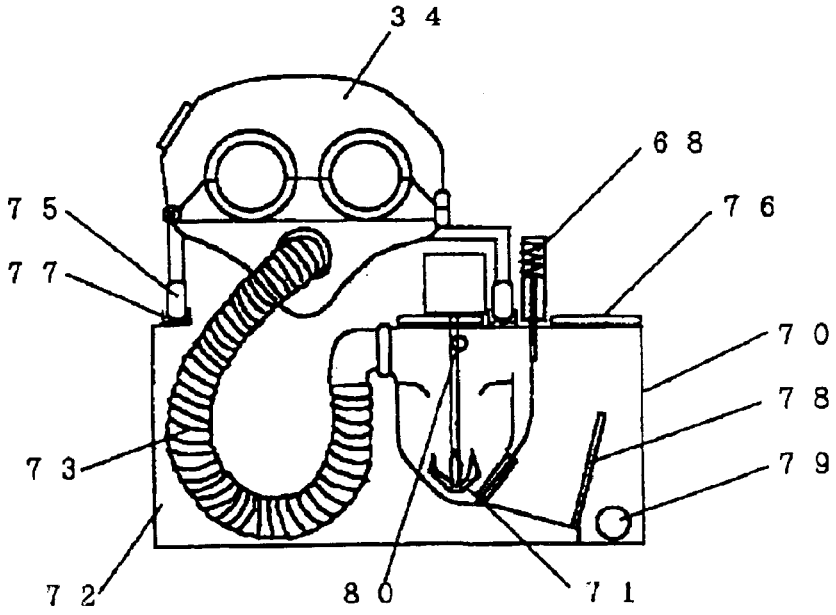
FIG. 15 is a side cross sectional view in which a toilet is attached above a bath tub.
Figure 16:
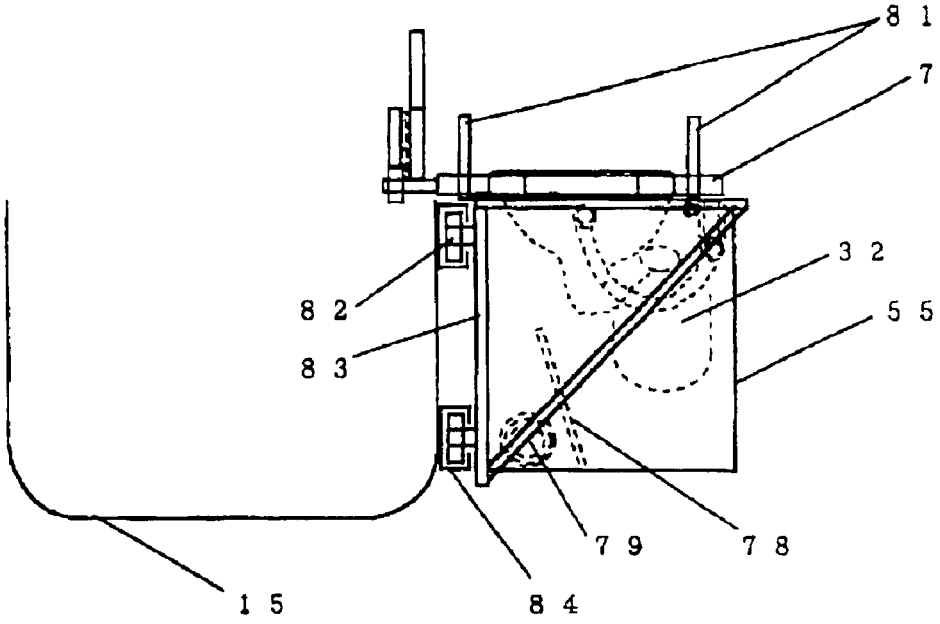
FIG. 16 is a side cross sectional view in which a toilet is attached along rails and exterior to the bath tub.

Although in the above embodiment the toilet is installed in the bath tub by providing rails in the bath tub, rails 77 may be provided on the bath tub 15 as shown in FIG. 14 and FIG. 15 or rails 84 may be provided exterior to the bath tub 15 as shown in FIG. 16.

In FIGS. 14 through 16, reference numeral 66 represents a water boiler; 67 represents a shower; 68 represents a solenoid; 69 represents a temperature control valve; 70 represents a wastewater tank; 71 represents a cutter (crusher); 72 represents a hose storage box; 73 represents a wastewater flexible hose; 74 represents a water feed hose; 75 represents a roller; 76 represents an opening for cleaning; 78 represents a net; 79 represents a wastewater tube; 80 represents a washing nozzle; 81 represents hand rails; 82 represents a roller; and 83 represents an angle member.

Figure 17:
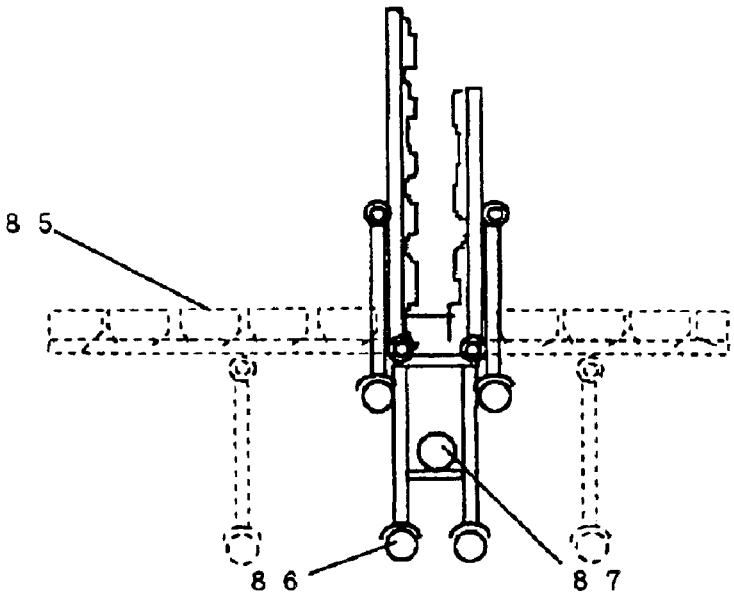
FIG. 17 is a front view of an air mattress type folding bed.

An air mattress type folding bed 85 having an air pump as shown in FIG. 17 also may be provided in order to temporarily place the sufferer thereon for cleaning or maintaining the bath tub of the care bed.

In FIG. 17, reference numeral 86 represents a spherical roller and 87 represents an air pump.

As described above, the care bed used commonly for bathing and toileting according to the present invention can minimize the labor burden on a carer responsible for the care of a bedridden sufferer. This allows even a carer of advanced age alone to take care of nursing operations for the sufferer such as bathing and toileting. Further, by employing hydraulic lifts for the lifts, smooth movements are attained and sufferers receive no physical pains.

INDUSTRIAL APPLICABILITY

As described above, the care bed used commonly for bathing and toileting according to the present invention is suitable for a care bed for reducing the labor burden to the carer and the sufferer as much as possible.

What is claimed is:

1. A care bed used commonly for bathing and toileting, comprising:

toilet means including a toilet that allows a user to use the toilet while lying down on the bed, a cover for opening and closing an upper face of the toilet, the cover being provided with gloves for cleaning in the toilet, and a cutter for cutting waste in the toilet;

a bath tub supporting the toilet means in a slidable mariner;

a bed having a plurality of vertical grooves disposed on the bath tub, the bed being attached so as to open and close the upper face of the bath tub by opening and closing means comprising a hydraulic machine having a hydraulic pump for opening and closing the bath tub; and a lift having arms to be inserted into the plurality of vertical grooves, and capable of horizontally lifting and moving back and forth the arms after the arms are inserted to the plurality of vertical grooves.

2. A care bed used commonly for bathing and toileting according to claim 1, wherein the lift comprises a hydraulic lift having a hydraulic pump; an arm adjustment hydraulic lift having a hydraulic pump for upper body; a fixed auxiliary hydraulic lift; and a bobbing type auxiliary hydraulic lift.

3. A care bed used commonly for bathing and toileting according to claim 1, wherein the lift comprises a wire suspension type lift; an arm adjustment hydraulic lift having a hydraulic pump for upper body; a fixed auxiliary hydraulic lift; and a bobbing type auxiliary hydraulic lift.

4. A care bed used commonly for bathing and toileting according to claim 1, wherein the lift comprises a worm screw type lift; an arm adjustment hydraulic lift having a hydraulic pump for upper body; a fixed auxiliary hydraulic lift; and a bobbing type auxiliary hydraulic lift.

5. A care bed used commonly for bathing and toileting, comprising:

toilet means including a toilet on which a user can sit and a cutter for cutting waste in the toilet;

a bath tub supporting the toilet means in a slidable manner;

a bed having a plurality of vertical grooves disposed on the bath tub, the bed being attached so as to open and close the upper face of the bath tub by opening and closing means comprising a hydraulic machine having a hydraulic pump for opening and closing the bath tub; and a lift having arms to be inserted into the plurality of vertical grooves, and capable of horizontally lifting and moving back and forth the arms after the arms are inserted to the plurality of vertical grooves.

6. A care bed used commonly for bathing and toileting according to claim 5, wherein the lift comprises a hydraulic lift having a hydraulic pump; an arm adjustment hydraulic lift having a hydraulic pump for upper body; a fixed auxiliary hydraulic lift; and a bobbing type auxiliary hydraulic lift.

7. A care bed used commonly for bathing and toileting according to claim 5, wherein the lift comprises a wire suspension type lift; an arm adjustment hydraulic lift having a hydraulic pump for upper body; a fixed auxiliary hydraulic lift; and a bobbing type auxiliary hydraulic lift.

8. A care bed used commonly for bathing and toileting according to claim 5, wherein the lift comprises a worm screw type lift; an arm adjustment hydraulic lift having a hydraulic pump for upper body; a fixed auxiliary hydraulic lift; and a bobbing type auxiliary hydraulic lift.

* * * * *